US007481051B2

(12) United States Patent
Bergquist

(10) Patent No.: US 7,481,051 B2
(45) Date of Patent: Jan. 27, 2009

(54) TREE FELLER POWER MANAGEMENT

(75) Inventor: Ulf Bergquist, Woodstock (CA)

(73) Assignee: Timberjack Inc., Woodstock, Ontario (CA)

( * ) Notice: Subject to any disclaimer, the term of this patent is extended or adjusted under 35 U.S.C. 154(b) by 700 days.

(21) Appl. No.: 11/100,675

(22) Filed: Apr. 7, 2005

(65) Prior Publication Data

US 2005/0226738 A1 Oct. 13, 2005

Related U.S. Application Data

(60) Provisional application No. 60/560,494, filed on Apr. 8, 2004.

(51) Int. Cl.
*F16H 61/40* (2006.01)
*A01G 23/00* (2006.01)

(52) U.S. Cl. ..... 60/422; 60/428; 60/465; 144/4.1; 144/34.1

(58) Field of Classification Search ..... 60/421, 60/422, 486, 428, 430, 452, 465; 144/4.1, 144/34.1, 336; 417/216, 286
See application file for complete search history.

(56) References Cited

U.S. PATENT DOCUMENTS 3,767,327 A * 10/1973 Wagenseil ..... 417/216
3,848,648 A * 11/1974 Dika et al. ..... 144/4.1
3,918,546 A 11/1975 Chichester et al.
4,091,617 A * 5/1978 Cornell ..... 60/465
4,248,573 A * 2/1981 Uehara et al. ..... 60/486
4,697,418 A * 10/1987 Okabe et al. ..... 60/431
5,913,663 A * 6/1999 Erkkilae et al. ..... 60/428
5,996,342 A 12/1999 Khan et al.
6,267,163 B1 * 7/2001 Holmes ..... 144/4.1
6,325,170 B2 12/2001 Christensen et al.
6,823,672 B2 * 11/2004 Nakamura ..... 60/452
7,076,947 B2 * 7/2006 Ariga et al. ..... 60/452

* cited by examiner

*Primary Examiner*—Thomas E Lazo
(74) *Attorney, Agent, or Firm*—Quarles & Brady LLP

(57) ABSTRACT

A tree felling machine has a main pump for operating functions of the machine such as the drive wheels or tracks, the steering, the brakes, and the lifting and extension of the boom, and a separate saw pump for driving the cutting element, for example, a circular disc saw driven by a hydraulic motor. Both pumps are driven by the same prime mover, i.e. the same internal combustion engine, and the power division between the two pumps is determined by the operator and by the hydraulic control system. In particular, a control provided in the cab is controllable by the human operator to limit the maximum power that the saw pump can draw from the prime mover. In addition, the power that the saw pump can draw from the prime mover is limited by a combination of the displacement setting of the main pump, the output pressure of the saw pump, and the pressure exerted on the load by the main pump.

16 Claims, 1 Drawing Sheet

TO MAIN VALVE
SM
V1
+
M
MP
L1
SP
S1
O1
PP1
L2
V2
50
25
100
C

SP
S1
PP1
V5
V6
PP2
O1
O3
$D_s$
$P_s$
$C_s$
B
S
L
L1
O2
O5
O4
V3
V4
$D_m$
$P_m$
$C_m$
P1
P2
MP

TREE FELLER POWER MANAGEMENT

CROSS-REFERENCE TO RELATED APPLICATION

This claims the benefit of U.S. Provisional Patent Application No. 60/560,494 filed Apr. 8, 2004.

STATEMENT CONCERNING FEDERALLY SPONSORED RESEARCH OR DEVELOPMENT

Not applicable.

FIELD OF THE INVENTION

This invention relates to fellers for cutting down trees, and in particular to a hydraulic control system for a tree feller for managing the division of power available for the cutting and other functions of the feller.

BACKGROUND OF THE INVENTION

Tree fellers for cutting trees, called feller/bunchers if they have accumulating arms, are well known in the logging industry. In a typical arrangement, a disc saw is carried at the front of a boom of a back hoe type vehicle, that may be a tracked or wheeled vehicle, that has a gasoline or diesel engine. The engine typically drives two or more variable displacement hydraulic pumps, at least one of which is for the drive functions of the vehicle and the other of which is for turning the disc saw. In the past, the engine power useable to drive these two pumps has been determined by the characteristics of the pump and by the load to which the pump was subjected. The displacement of both pumps is manually controlled by the operator with suitable controls provided in the cab. Usually, the saw drive pump is operated at full displacement once the saw is brought up to speed, and the main pump displacement is controlled by the operator, depending on how fast the operator wants to operate the machinery or the loading placed on the machine by the various functions of the machine, with limits placed on it by the system so as not to overload the prime mover. However, there are times when it is desirable to limit the amount of engine power available to drive the saw, so as to make more power available for the other machine functions, such as driving the wheels or track in rough terrain, operating the clamp arms of the saw head in windy conditions, or operating the boom with a large load of trees held by the saw head, or while cutting a tree. This invention is directed toward a new way to divide power between the saw and main pumps in a tree felling machine.

SUMMARY OF THE INVENTION

A tree felling machine of the invention has a hydraulic system that has at least two hydraulic pumps operated by the same prime mover, the two pumps including a pump for driving a cutting element of the machine and the other pump being a main pump for providing fluid under pressure to operate other functions of the machine. In one aspect of the invention, the machine has a control in the cab, apart from any manually adjustable pump displacement controls operable by the operator, that is adjustable by the operator so as to place an upper limit on the amount of power the saw pump can draw from the prime mover. Thereby, the operator can limit the saw power so as to make more power available to operate the other functions of the machine.

Preferably, the control can be set by the operator to result in automatic de-stroking of the saw pump when the saw pump pressure reaches the limit set by the operator.

In another aspect of the invention, de-stroking of the saw pump is automatically effected at least in part in response to a displacement setting of the main pump. If the main pump is operating at full displacement, the combination of saw pump and main pump output pressures necessary to de-stroke the saw pump will be less than if the main pump is being de-stroked by the main pump de-stroking cylinder. Likewise, if there is no or relatively little load on the main pump, it will be automatically de-stroked so that a relatively high power is available to be used by the saw pump and therefore it would take a relatively higher saw pump pressure to result in de-stroking the saw pump.

In another aspect of the invention, a saw pump de-stroking valve has opposed pilot pressure ports that normally balance each other when the saw pump is not being de-stroked in a non-de-stroking position of the de-stroking valve, but that when imbalanced, move the de-stroking valve into a position in which the valve pressurizes a saw pump de-stroking cylinder to reduce the displacement of the saw pump, and thereby reduce the power consumed by the saw pump. The pilot pressure ports of the de-stroking valve include a non-destroking port that when pressurized biases the de-stroking valve into the non-de-stroking position. The non-de-stroking port is in communication with a limit valve that vents the non-de-stroking port to a pressure that permits the de-stroking valve to de-stroke the saw pump dependent, at least in part, on the displacement setting of the main pump, the pressure exerted by the saw pump, and the pressure exerted on the load by the main pump. Thus, more power will be available to the saw pump if the main pump load pressure is lower, and/or if the main pump is de-stroked.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figures 1, 2:
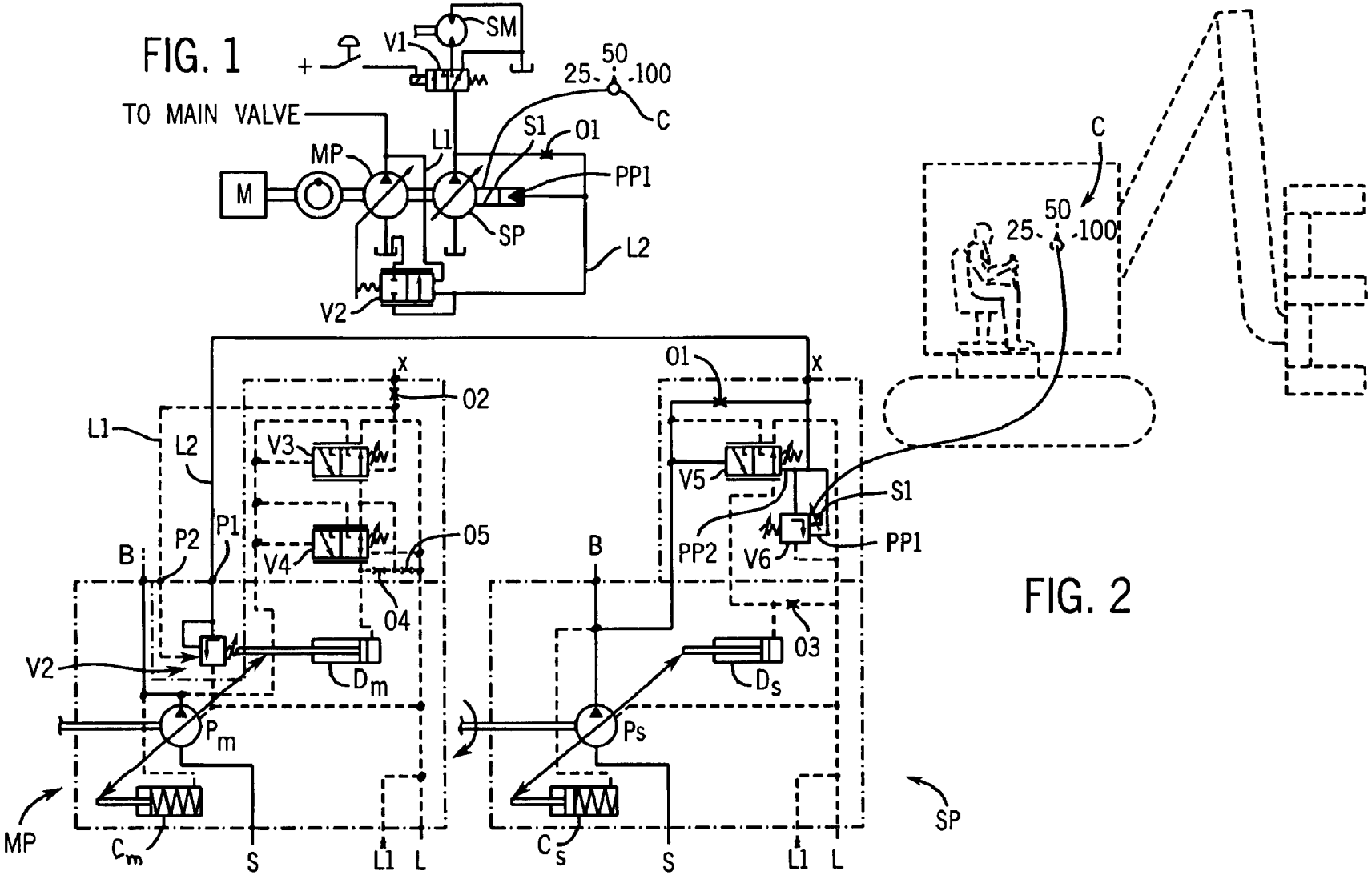
FIG. 1 is a schematic hydroelectric circuit diagram for a control system of the invention.
FIG. 2 is a more detailed schematic of the hydroelectric circuit of FIG. 1.

A common prime mover M, such as a gasoline or diesel engine, drives both a main pump unit MP (also sometimes referred to as a boom pump unit) and a saw pump unit SP. Each of the pump units MP and SP includes a variable displacement pump $P_m$ or $P_s$ (FIG. 2) respectively such as a variable displacement axial piston pump. The pump units MP and SP also are provided with a number of other valves and orifices as indicated in FIG. 2 by the components within the alternating long and short dashed line boxes, that represent the envelopes or housings of the pump units. The output from the boom pump unit MP goes to the main valve (not shown) through the port B that is connected to pump $P_m$ in FIG. 2, the main valve being operated by the machine operator to provide control of the hydraulic power delivered to the various functions of the machine, such as the boom lift and extension cylinders, the drive motors for the drive wheels or tracks of the vehicle, the steering system of the vehicle, the brakes, and the clamp arms of the saw head. The output of the saw pump unit SP is directed to an on/off saw valve V1 (in FIG. 2, the port B connected to the pump $P_s$ is connected to the valve V1, not shown in FIG. 2) and from there to the saw motor SM, which drives the cutting element of the feller, such as a disc saw blade.

In a system of the invention, the operator is able to select the power split between the saw pump unit SP and the main pump unit MP. As seen in FIG. 1, the operator is provided with a control C, for example a potentiometer, that is connected to a solenoid S1 of the saw pump unit SP. If the operator wants the saw pump unit SP to be able to draw as much power as possible from the prime mover M, the operator sets the control to 100 and, as long as the main pump unit MP does not demand more power than what the prime mover M can produce, when combined with the demand from the saw pump unit SP, the saw pump unit SP will run at maximum capacity. However, if the operator wants to limit the maximum power that the saw pump can draw, the operator can set the control C to a value less than 100, which will place a limit on the amount of prime mover power that the saw pump unit SP can draw.

Also illustrated in FIG. 1 is a limit valve V2 that is controlled on its right side by the stroke setting of the main pump unit MP and receives two pilot pressure inputs on its left side, one from the load sense pressure of the main pump unit MP and the other from the output of the saw pump SP. If the main pump unit MP is operating at its maximum displacement, the spring force on the right side of the valve V2 will be reduced so that only a relatively low combination of the pressures acting on the left side of valve V2 will keep valve V2 closed. If either or both of the pressures on the left pilot pressure ports of valve V2 increase enough, valve V2 will open, which will vent the pilot pressure acting at pilot pressure port PP2 of valve V5 of the saw pump unit SP to tank, which has the effect of de-stroking (i.e., reducing the displacement and therefore the flow rate of) the saw pump unit SP and thereby relieving the power demand of the saw pump unit SP on the prime mover M. This makes more power available to the main pump MP. It is noted that the operator adjusting the control C downwardly also de-strokes the saw pump unit SP, to relieve the power demand on the motor M by the saw pump unit SP, thereby making more of the prime mover power available to the main pump unit MP.

Referring to FIG. 2, detailed schematics of the main pump unit MP and saw pump unit SP are illustrated, and it is illustrated how they are connected together. The components contained within the prior art pump units MP and SP were not modified to create the invention, but what was changed was the plumbing of ports P1 and P2 of the main pump unit MP, the connection of port X of the saw pump unit SP to the port P1 of the main pump unit MP, and the addition of an external electrical control in the vehicle cab to control a proportional electric valve of the saw pump unit SP, as described below, for the operator to be able to remotely control the setting of the proportional electrical valve S1 of the saw pump unit SP. In the main pump unit MP as it existed previously, port P1 was connected to the internal circuit of the main pump unit at the point below orifice O2, where the upper line connected to P2 is connected in FIG. 2, and P2 was not connected there but was unused (plugged) or used for another purpose. In making the invention, this line was connected to P2, as illustrated in FIG. 2, and the X port of the prior art saw pump unit SP was connected to port P1 of the main pump unit MP, as illustrated in FIG. 2.

Referring to the main pump unit MP, as stated above, the main pump unit MP includes a pump $P_m$ that draws from tank port S, and ports L1 and L are also drain ports that are connected to the tank (not shown), like S. X is the load sense pressure port which is connected to the load sense pressure port of the main valve (not shown). As is well known, the main pump output B is connected to the pressure input port of the main valve and the main valve is controlled by the operator to direct hydraulic pressure to the various functions of the machine such as the drive system, steering system, boom control, clamp arms, etc. The load sense pressure is the pressure demanded by the operator, downstream of the main valve, that is determined by the load and the operator's operation of the machine. If no or relatively low load is being called for by the operator, the main pump will be de-stroked to no or relatively low flow, so as to conserve energy. As the load sense pressure at port X builds, it makes it more likely that the saw pump unit SP will be destroked by the action of valve V2, as further described below.

The main pump $P_m$ also has a leakage line that is connected to L and L1. The output from the pump $P_m$ is also connected to three-way, two-position valve V3 and to three-way, two-position valve V4. Valve V3 is a load sense valve that accelerates the main pump so as to balance the pump output and load sense pressures, and valve V4 is a valve that protects the main pump from high pressure. The left side pilot pressure ports of the valves V3 and V4 are connected to the output of the pump $P_m$ and the right side pilot pressure port of the valve V3 is connected to the load sense port X, through orifice O2. The right side of the protection valve V4 is connected to the drain port L. If the pump $P_m$ output pressure gets too high, valve V4 is shifted to the right against its adjustable spring, which connects the output of the pump $P_m$ to the input of de-stroking cylinder $D_m$, which moves the piston of the cylinder $D_m$ leftwardly and has a mechanical linkage to the pump $P_m$ so as to reduce its displacement and therefore its flow rate. This action is reacted against by start-up cylinder $C_m$ that has an internal spring that reacts against de-stroking the pump $P_m$, in combination with a connection to the pump output pressure that biases the pump toward the fully stroked (maximum flow rate) state. The cylinder $C_m$ is provided for the main function of biasing the pump $P_m$ into a fully-stroked, or maximum displacement position, as is desirable especially at start-up of the machine.

Pressurizing the cylinder $D_m$ has the effect of reducing the displacement, and therefore the flow output, of the pump $P_m$. In addition, actuating the de-stroke cylinder $D_m$ leftwardly also acts on the adjustable spring of valve V2 to further compress the spring and therefore increase the force that biases the valve V2 closed, which is the same valve V2 as shown in FIG. 1, although schematically depicted somewhat differently. As seen, de-stroking pump $P_m$ tends to close valve V2, so as to close off the connection through it of port P1 of the main pump unit MP to tank, through port L and $L_1$.

Valve V2 (FIG. 2) also has its two leftward pilot pressure ports connected, one to port P1 and the other to port P2 of the main pump unit MP. As stated above, port P2 is connected to the load sense port X of the main pump unit MP below orifice O2. In FIG. 2, line L1 corresponds to line L1 in FIG. 1, and line L2 in FIG. 2 corresponds to line L2 in FIG. 1.

Orifices O5 and O4 are provided to relieve the pressure in the respective lines between V3 and V4 and between V4 and $D_m$ to tank, to assure that leakage does not build-up pressure that would falsely move the de-stroking cylinder $D_m$ to a de-stroked position.

Port P1 of the main pump unit MP is connected to port X of the saw pump unit SP. Port X is connected to orifice O1, which corresponds to the orifice O1 in FIG. 1. Orifice O1 is connected to the outlet port B of the saw pump $P_s$. The displacement stroke of the saw pump $P_s$ is controlled by the de-stroking cylinder $D_s$ and by the start-up cylinder $C_s$, much like in the main pump unit MP. Also, as in the main pump unit MP, the ports S, L1, and L of the saw pump unit SP are all connected to tank. The leakage port from the pump $P_s$ is also connected to port L and therefore to tank. The pump $P_s$ output line is connected to the pilot pressure port of three-way, two-position valve V5, that is biased leftwardly by an adjustable spring, and to the pressure port of the valve V5, and through the orifice O1 to port X, and from there to the right side pilot pressure port of valve V5, and to the pressure port and right side pilot pressure port of control valve V6. The opposite (lower as illustrated) side port of valve V5 is connected to the de-stroking cylinder $D_s$ and through an orifice O3 to the tank port L. The lower side port of valve V6 is also connected to tank through the port L, and the valve V6 has an adjustable spring on its left side and a proportional solenoid S1, which corresponds to S1 in FIG. 1, on its right side. On the right side of valve V6, the pilot pressure port is identified PP1, which corresponds to PP1 in FIG. 1, and is connected to the X port of the saw pump unit SP, which is connected through orifice 01 to the output of the saw pump $P_s$.

Valve V5 is balanced by the output pressure of the saw pump $P_s$ and by the pressure at port X of the saw pump unit SP, and also by the adjustable spring at the right side of the valve V5. As long as the pressure at port X of the saw pump unit SP is sufficiently high, valve V5 will stay in the position illustrated, with the output of the pump $P_s$ blocked. However, if the pressure at port X goes down sufficiently, valve V5 will be permitted to shift rightwardly, which will pressurize de-stroking cylinder $D_s$, and therefore reduce the displacement of the saw pump $P_s$, thereby off-loading the prime mover M.

The pressure at the port X of the saw pump unit SP can be relieved either through the valve V2 or through the valve V6. If an operator turns control C to a setting of 100, corresponding to a zero current to the adjustable solenoid S1, for example, the spring at the left of V6 will urge the valve V6 closed so that it will take a relatively higher pressure at port PP1 to open it, thereby relieving the pressure at port X to tank and shifting the valve V5 rightwardly and correspondingly de-stroking the saw pump $P_s$. If the operator sets the control C to, for example, 50, then the solenoid S1 will be exerting a force on the valve V6 tending to move it leftwardly, so it will take less pressure at port PP1 to shift the valve V6 to an open state, which, as stated above, has the effect of shifting valve V5 rightwardly and de-stroking the saw pump $P_s$.

The saw pump $P_s$ can also be de-stroked by the main pump unit MP, depending on its operating conditions. This happens when the pressure at point P1 is reduced sufficiently so as to allow valve V5 to shift into its rightward position. The pressure at port P1 is controlled by the valve V2, which is dependent on the pressure at port X of the saw pump unit SP, on the load sense pressure input to the main pump through port X of the main pump unit MP downstream of orifice O2, and by the stroke setting of the main pump $P_m$. If the main pump $P_m$ is fully stroked, the force exerted by the adjustable spring on the right side of valve V2 will be reduced relative to what it would be if the main pump $P_m$ were de-stroked, so that a lower load sense pressure in line L1 would tend to open the valve V2, than would be the case if the pump $P_m$ were at least partially de-stroked. Opening valve V2 vents port X of the saw pump $P_s$ to tank, which shifts valve V5 rightwardly thereby de-stroking the saw pump. The pressure required in line L1 to open valve V5 is also reduced if the pressure at port X of the saw pump unit SP is greater, since that pressure adds to the force acting on the same side of the valve V2 as does the pressure in line L1. If the main pump $P_m$ is at least partially de-stroked, the spring acting on the right side of valve V2 is compressed by the de-stroking cylinder $D_m$, which causes the force acting on the right side of valve V2 to be greater, which force biases the valve V2 closed. Under those conditions, the combination of forces produced by the two pilot pressures acting on the left side of valve V2 must be greater in order to open the valve V2. Opening valve V2 has the effect of de-stroking the saw pump $P_s$. Thus, when the main pump is operating at less than full flow rate, more power is available for use by the saw pump $P_s$, for a given pressure of the main pump, than at full main pump flow rate, at the same main pump pressure. Thereby, the power available to be used by the saw pump is set by the operator with the control C, but can be no greater than that available as determined by the requirements of the main pump.

A preferred embodiment of the invention has been described in considerable detail. Many modifications and variations to the preferred embodiment described will be apparent to a person of ordinary skill in the art. Therefore, the invention should not be limited to the embodiment described.

I claim:

1. In a tree felling machine having an operator cab and a hydraulic system that has at least two hydraulic pumps operated by the same prime mover, said two pumps including a pump for driving a cutting element of the machine and the other pump being a main pump for providing fluid under pressure to operate other functions of the machine, the improvement wherein the machine has a control in the operator cab that is adjustable by the operator, apart from any manually adjustable pump displacement controls operable by the operator, so as to place an upper limit on the amount of power the saw pump can draw from the prime mover while reserving any remaining power for operation of the other functions.

2. The improvement of claim 1, wherein the control operated by the operator adjusts the pressure of the saw pump at which the saw pump will be automatically de-stroked by the hydraulic control system so as to limit the amount of power the saw pump can draw from the prime mover.

3. The improvement of claim 2, wherein the control operated by the operator adjusts a control valve that is actuated by a pilot pressure that is responsive to an output pressure of the saw pump, the control valve operating so that if the control valve is opened by the combination of the operator set adjustment and the pilot pressure that is dependent upon the output pressure of the saw pump, the saw pump is de-stroked by the hydraulic control system so as to reduce the amount of power the saw pump draws from the prime mover.

4. The improvement of claim 3, wherein the control valve normally blocks communication between a pilot pressure port of a de-stroking valve and a lower pressure, the control valve opening to vent the de-stroking valve pilot pressure port to the lower pressure when the saw pump pressure reaches a sufficient level so as to result in the de-stroking valve operating to de-stroke the saw pump.

5. The improvement of claim 4, wherein the de-stroking valve has a second pilot pressure port that is in communication with a pressure that is dependent upon the output pressure of the saw pump.

6. The improvement of claim 5, wherein the control valve is normally biased to a closed state and wherein a biasing force on said control valve is adjustable.

7. The improvement of claim 5, wherein the de-stroking valve is normally biased to a non-de-stroking state and a biasing force on said valve to bias it to the non-de-stroking state is adjustable.

8. In a tree felling machine having a hydraulic system that has at least two hydraulic pumps operated by the same prime mover, said two pumps including a pump for driving a cutting element of the machine and the other pump being a main pump for providing fluid under pressure to operate other functions of the machine, the improvement wherein de-stroking of the saw pump is automatically effected at least in part in response to a displacement setting of the main pump.

9. The improvement of claim 8, wherein the de-stroking of the saw pump is at least in part dependent on an output pressure of the saw pump.

10. The improvement of claim 8, wherein the de-stroking of the saw pump is at least in part dependent on a pressure exerted on a load by the main pump.

11. The improvement of claim 8, further comprising a saw pump de-stroking valve having a pilot pressure port that when pressurized biases the saw pump de-stroking valve into a non-de-stroking state, and wherein said pilot pressure port is in communication with a limit valve that is normally biased closed by a force that is at least in part dependent on a displacement setting of the main pump.

12. The improvement of claim 11, wherein the biasing force normally biasing the limit valve closed is at least in part dependent on a spring force that is adjustable.

13. The improvement of claim 12, wherein the limit valve has a pilot pressure port that when pressurized biases the limit valve open and that is in communication with a pressure that is dependent on a pressure exerted on the load by the main pump.

14. The improvement of the claim 13, wherein the limit valve has a second pilot pressure port that when pressurized biases the limit valve open and that is in communication with a pressure that is dependent on the saw pump output pressure.

15. In a tree felling machine having a hydraulic system that has at least two hydraulic pumps operated by the same prime mover, said two pumps including a pump for driving a cutting element of the machine and the other pump being a main pump for providing fluid under pressure to operate other functions of the machine, the improvement wherein the saw pump has a de-stroking valve with opposed pilot pressure ports that normally balance each other when the saw pump is not being de-stroked to result in the de-stroking valve being in a non-de-stroking position of the de-stroking valve in which the saw pump is not de-stroked by the valve, but that when imbalanced, moves the de-stroking valve into a position in which the de-stroking valve pressurizes a saw pump de-stroking cylinder to reduce the displacement of the saw pump, said ports including a non-de-stroking port which when pressurized biases the de-stroking valve into the non-de-stroking position, the non-de-stroking port being in communication with a limit valve that vents the non-de-stroking port to a lower pressure that permits the de-stroking valve to de-stroke the saw pump at least in part dependent on the displacement setting of the main pump, the pressure exerted by the saw pump, and the pressure exerted on the load by the main pump.

16. The improvement of claim 15, further comprising a control valve that vents the non-de-stroking port of the saw pump de-stroking valve dependent on a combination of a setting made by the operator of the vehicle and the pressure exerted by the saw pump such that upon venting the non-de-stroking port the saw pump is de-stroked so as to reduce the power transmitted from the prime mover to the saw pump.

* * * * *